US006883503B2

(12) United States Patent
Carroll

(10) Patent No.: US 6,883,503 B2
(45) Date of Patent: Apr. 26, 2005

(54) ENGINE DRIVEN SUPERCHARGER FOR AIRCRAFT

(76) Inventor: Ernest A. Carroll, 12913 Alton Sq., No. 114, Herndon, VA (US) 20170

( * ) Notice: Subject to any disclaimer, the term of this patent is extended or adjusted under 35 U.S.C. 154(b) by 0 days.

(21) Appl. No.: 10/255,189

(22) Filed: Sep. 26, 2002

(65) Prior Publication Data

US 2004/0060548 A1 Apr. 1, 2004

(51) Int. Cl.[7] ..... F02B 33/00

(52) U.S. Cl. ..... 123/564; 123/561; 123/559.1; 60/605.1; 416/198 R

(58) Field of Search ..... 123/564, 561, 123/559.1; 416/198 R, 134 A, 147; 60/226.3, 605.1

(56) References Cited

U.S. PATENT DOCUMENTS 2,358,363 A * 9/1944 Truesdell ..... 123/564
2,390,161 A * 12/1945 Mercier ..... 123/564
2,401,365 A * 6/1946 Mercier ..... 123/561
2,653,591 A * 9/1953 Cole et al. ..... 123/561
4,446,696 A * 5/1984 Sargisson et al. ..... 60/226.3
5,537,909 A 7/1996 Schneider et al.
6,062,176 A 5/2000 Berger
6,327,857 B1 * 12/2001 Fredriksson ..... 60/605.1
6,328,024 B1 * 12/2001 Kibort ..... 123/559.1
6,340,289 B1 * 1/2002 Vos et al. ..... 60/602

FOREIGN PATENT DOCUMENTS

GB 2192943 A * 1/1988 ..... B64C/11/06

* cited by examiner

*Primary Examiner*—Thai-Ba Trieu
(74) *Attorney, Agent, or Firm*—David L. Banner

(57) ABSTRACT

A supercharging system for supplying pressurized combustion air to a piston engine of an aircraft at high altitudes. The engine has an output shaft on which the propeller is supported, together with a small ducted centrifugal fan. The duct leads to the intake side of the engine. A diverter is movable to one position constraining pressurized air to enter the engine through the intake side, and a second position which diverts compressed air away from the intake side. Natural aspiration is employed at low altitudes and supercharging is employed at altitudes wherein there is an oxygen deficiency. Preferably, the centrifugal fan is located between the propeller and the engine block, has blades staggered from those of the propeller so as to be directly exposed to incoming air. The centrifugal fan blades are preferably of different pitch than the propeller blades.

13 Claims, 3 Drawing Sheets

ENGINE DRIVEN SUPERCHARGER FOR AIRCRAFT

REFERENCE TO RELATED APPLICATION

This application is related to copending applications respectively entitled UNMANNED AIRCRAFT WITH AUTOMATIC FUEL-TO-AIR MIXTURE ADJUSTMENT, Ser. No. 10/255,184; MINIATURE UNMANNED AIRCRAFT WITH ONBOARD STABILIZATION AND AUTOMATED GROUND CONTROL OF FLIGHT PATH, Ser. No. 10/255,183; MINIATURE UNMANNED AIRCRAFT WITH AUTOMATICALLY DEPLOYED PARACHUTE, Ser. No. 10/255,185; MANUALLY DISASSEMBLED AND READILY SHIPPABLE MINIATURE, UNMANNED AIRCRAFT WITH DATA HANDLING CAPABILITY, Ser. No. 10/255,182; CABLE CONNECTIONS BETWEEN AN UNMANNED AIRCRAFT AND A DETACHABLE DATA HANDLING MODULE, Ser. No. 10/255,187; ELECTRICAL POWER SUPPLY SYSTEM FOR UNMANNED AIRCRAFT, Ser. No. 10/255,188; and MINIATURE, UNMANNED AIRCRAFT WITH INTERCHANGEABLE DATA MODULE, Ser. No. 10/255,186; all filed on even date herewith and which are incorporated herein by reference, and to copending Provisional Application Ser. No. 60/324,931, filed Sep. 27, 2001.

BACKGROUND OF THE INVENTION

1. Field of the Invention

The present invention relates to miniature, unmanned aircraft and provides high altitude capabilities. More particularly, the present invention relates to a compact, light weight, low cost reciprocating piston engine having a supercharging arrangement suitable for enabling high altitude operation.

2. Description of the Prior Art

Unmanned aircraft, particularly those remotely controlled by radio frequency signals, are generally limited in altitude capabilities. High altitude operation is conducted under conditions of reduced air density and also of decreasing relative oxygen content of the air. Turbine engines are able to accommodate high altitude flight, but are impractical in certain roles. Reciprocating piston engines require supercharging to cope with high altitudes. Turbocharging can overcome oxygen deficiency at high altitude, but just as in the case of turbine engines, turbocharged engines are impractical in certain roles.

The role envisioned by the present invention concerns data acquisition and transmission of data from miniature, unmanned aircraft. An example of data acquisition is gathering of aerial imagery. Digital imagery or relayed messages provide examples of data transmission which may be performed by such aircraft. For maximum practicality and minimum costs, such aircraft must be free of licensing requirements imposed by the Federal Aviation Administration. This requires that the aircraft be less than fifty-five pounds in weight, restricted to maximum velocity capability of two hundred miles per hour, and constrained to obtain navigation or flight direction signals remotely.

Such aircraft can be built at reasonable costs using much technology available for so-called "model" aircraft. Apart from the above noted problem of oxygen deficiency, there is no reason why an aircraft powered by a reciprocating piston engine cannot fly at altitudes of twenty thousand feet and beyond. However, commercially available two- and four-stroke engines of one and two cylinders cannot cope with these high altitudes. It would be impractical to provide such engines with turbochargers and even with blower type superchargers due to constraints relating to bulk, weight, and costs. The use of turbine engines also presents problems unique to that type of engines. There remains a need for a compact, light weight, inexpensive apparatus for supercharging a reciprocating piston powered aircraft of less than fifty-five pounds gross weight.

SUMMARY OF THE INVENTION

The present invention solves the above problem by providing a supercharger driven by the engine output shaft which also drives the propeller. The supercharger comprises an auxiliary blade assembly of appropriate pitch characteristics and dimensions than the propeller, mounted behind the propeller in the manner of a ducted fan, and a diverter. At low altitudes, the diverter shunts most or all of the pressurized air past the engine combustion air intake, so that the supercharging effect is absent or minimal. As the altitude increases, the diverter reroutes progressively more of the pressurized air to the intake side of the engine. The amount of additional air is generally not enough to significantly increase engine power, but rather compensates for oxygen deficiency arising from high altitude operation so that the aircraft can operate beyond limits normally imposed on naturally aspirated engines. Pressurized air not routed to the engine intake is discharged into the engine bay of the aircraft where it mixes with cooling air.

Accordingly, it is one object of the invention to provide a form of supercharging which enables miniature, unmanned aircraft powered by reciprocating piston engines to operate at high altitudes, beyond limits normally imposed on naturally aspirated engines.

It is another object of the invention that the supercharging effect be absent or minimized at low altitudes.

It is a further object of the invention to provide such supercharging while maximizing compactness of the airframe, and minimizing weight, complexity, and costs.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
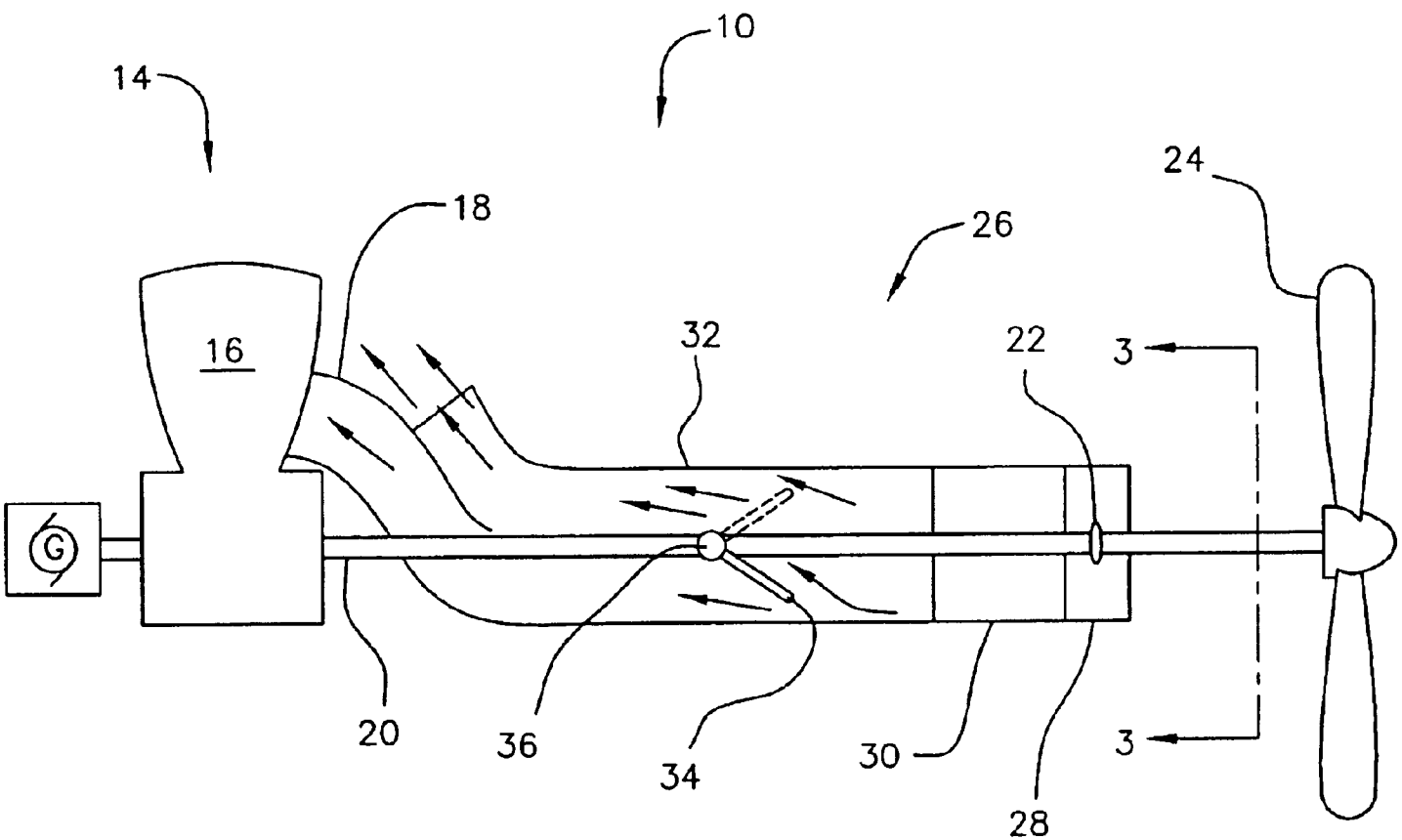
FIG. 1 is a diagrammatic, side elevational view of an engine and propeller assembly according to one embodiment of the invention, showing minimal supercharging.
Figure 4:
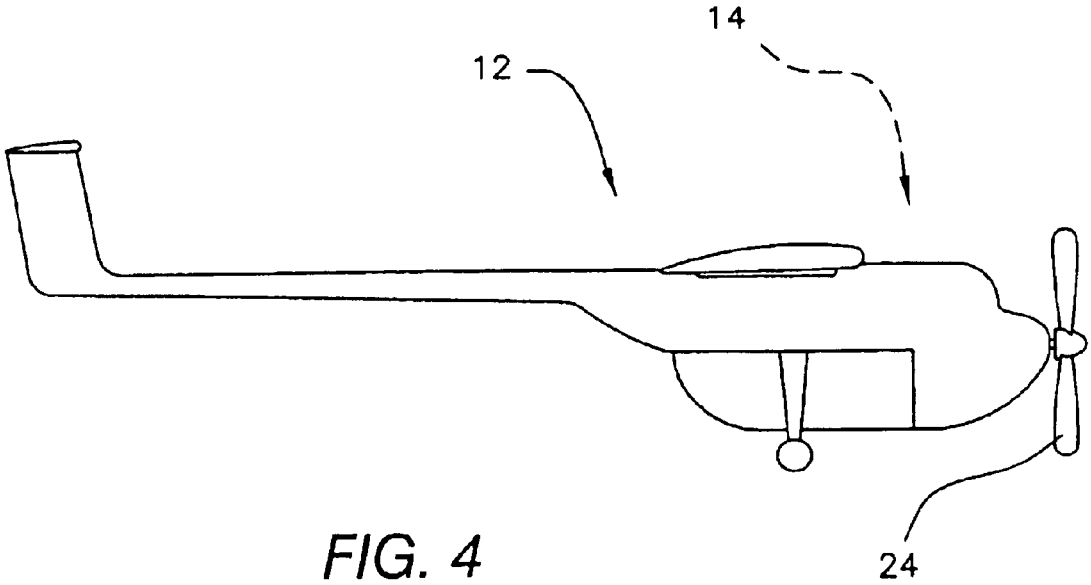
FIG. 4 is a side elevational view of an aircraft having a supercharged engine according to an embodiment of the present invention.

Turning now to FIG. 1 of the drawings, there is shown a supercharged reciprocating piston engine assembly 10 for a miniature, unmanned aircraft 12 (see FIG. 4). Engine assembly 10 comprises an engine 14 having an engine block defining at least one cylinder 16, and a piston (not separately shown) reciprocatingly and slidably disposed within cylinder 16, an intake passage 18 for conducting combustion air into cylinder 16, a rotatable output shaft 20 rotatably driven by engine 14. The foregoing components of engine 14 are conventional, and will be understood to include all conventional support systems required for operability, such as a cooling system, an ignition system, a fuel system, a lubrication system, and the like, regardless of whether such support systems are shown.

An air pressurization device such as axial flow fan 22 is mounted to output shaft 20 behind a propeller 24 which is also driven by output shaft 20. Although the air pressurization device preferably takes the form of axial flow fan 22, it could also take the form of a centrifugal blower (not shown) or any other device capable of pressurizing air. Propeller 24 provides propulsive power to fly. Axial flow fan 22 is located along shaft 20 between engine 14 and propeller 24. Axial flow fan 22 has blades (one blade is seen in end elevation in FIG. 3, where axial flow fan 22 is indicated) of pitch characteristics different from those of propeller 24. It will also be seen that the blades of axial flow fan 22 (only one is visible) are arranged in staggered relationship to the blades of propeller 24, in this case by ninety degrees, such that the blades of axial flow fan 22 are directly exposed to incoming air passing between the blades of propeller 24. The arrangement wherein blades of axial flow fan 22 are staggered with respect to those of propeller 24, and configuration of blade pitch of axial flow fan 22 combine to assure that axial flow fan 22 will be able to act on incoming air to pressurize this air.

Axial flow fan 22 is enclosed within a duct 26 which is open at the front (that side facing propeller 24). Duct 26 routes air pressurized by axial flow fan 22 to intake passage 18 of engine 14. A portion 28 of duct 26 which encloses fan 22 is of circular cross section. To the rear of portion 28 is a portion 30 of duct 26 which makes transition between circular cross section and square or rectangular cross section. The next portion 32 of duct 26 is square or rectangular in cross section.

A plate 34 pivotally supported on a shaft 36 serves as a diverter disposed selectively to route pressurized air into intake passage 18 of engine 14 and to discharge pressurized air away from intake passage 18. Plate 34 is infinitely or continuously adjustable or movable between a first position (shown in solid lines) wherein at least most of the pressurized air is constrained to flow away from intake passage 18, and a second position (shown in broken lines). Air flow is indicated by arrows. In the first position, the majority of the pressurized air, indicated by the larger number of arrows, is discharged in the engine bay (not separately shown) of aircraft 12, where it adds to cooling air and contributes to the cooling function.

Figure 2:
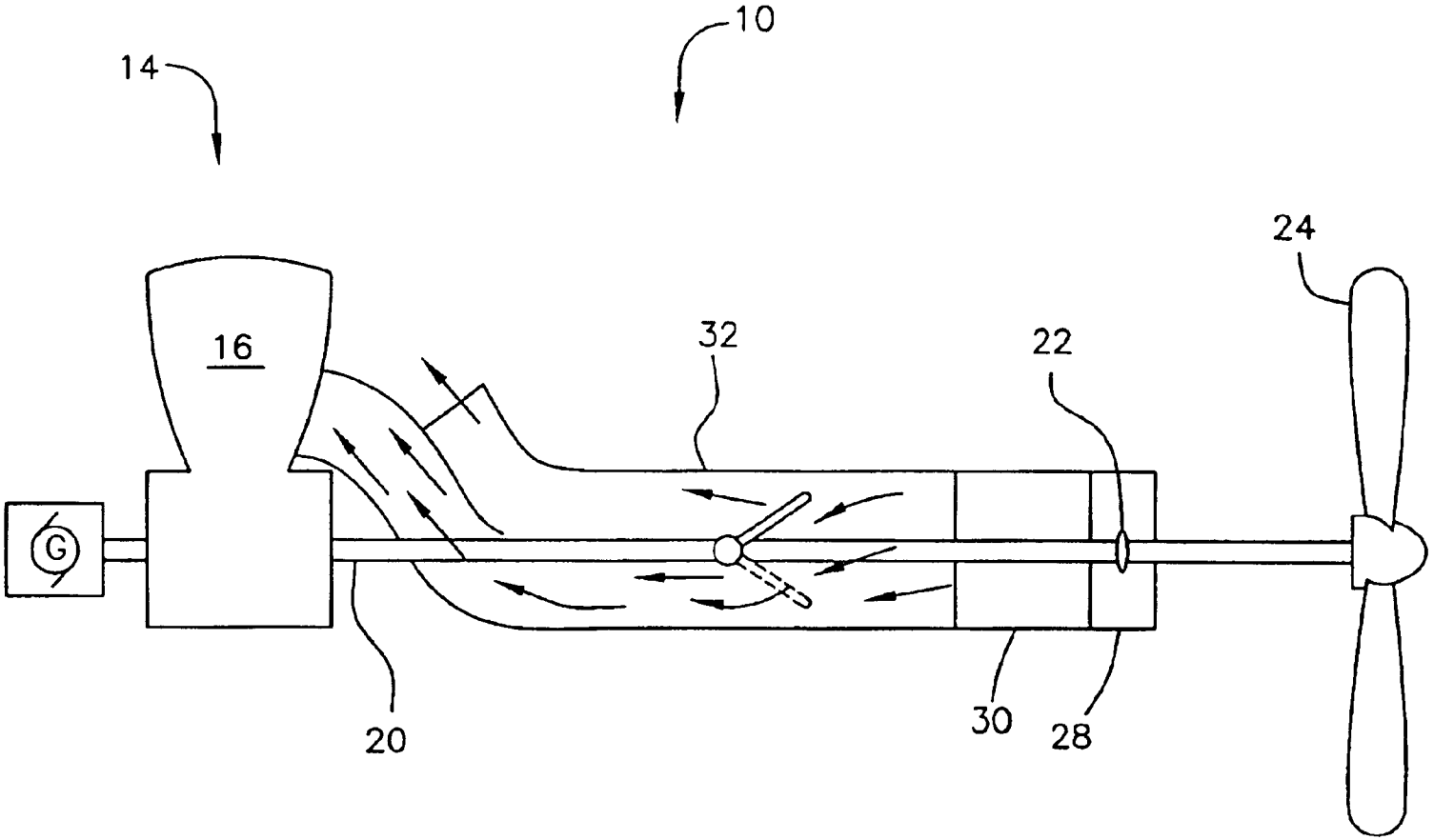
FIG. 2 is a diagrammatic, side elevational view as in FIG. 1, but showing a relatively great degree of supercharging.

Referring now to FIG. 2, in a second position shown in solid lines, at least most of the pressurized air is constrained to flow into intake passage (this is depicted in FIG. 2). FIGS. 1 and 2 respectively show preferred extreme positions of plate 34, it being understood that plate 34 can move to any selected intermediate position. Plate 34 is moved by any suitable servomechanism by direct radio signal, and preferably by a digital servomechanism where a microprocessor (not shown) is provided to manage flight (servomechanisms are not shown).

Figure 3:
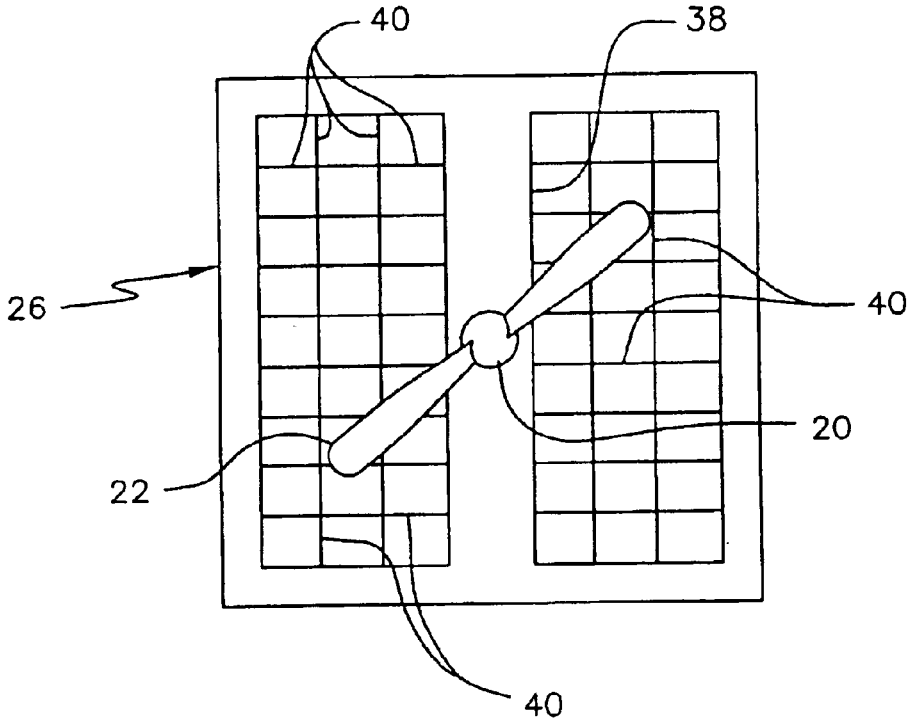
FIG. 3 is a front elevational detail view taken along line 3—3 of FIG. 1, drawn to enlarged scale.

FIG. 3 shows a preferred construction of duct 26. A vertical wall 38 divides duct 26 into two sections. The function of wall 38 is to prevent shaft 20 from interfering with the function of plate 34 and with orderly air flow. It will be understood that in the embodiment of FIG. 3, two generally similar diverters may be provided, so that similar control of air flow occurs in each of the two sections of duct 26. The diverters may employ plates (not shown) corresponding to plate 34 in function, mounted on and moved by a common shaft corresponding to shaft 36. This enables two different diverter plates to be operated by a single actuator (not shown).

Another feature shown in FIG. 3 is an air directing member comprising a grid of intersecting sheets 40 of a rigid material such as steel. Sheets 40, regardless of their angle to one another, are arranged parallel to air flow. This arrangement promotes laminar air flow by forcing air to flow in a direction parallel to the walls of duct 26. The grid of sheets is located within duct 26 at any suitable location for accomplishment of this purpose. Angles between intersecting individual sheets 40 may be varied from the perpendicular angles depicted herein.

It is to be understood that the present invention is not limited to the embodiments described above, but encompasses any and all embodiments within the scope of the following claims.

I claim:

1. A supercharged reciprocating engine assembly for a miniature, unmanned aircraft, comprising:

an engine sized and configured for powering said miniature, unmanned aircraft and having an engine block defining at least one cylinder, and a piston reciprocatingly and slidably disposed within each cylinder;

a single air intake passage for conducting combustion air into said at least one cylinder;

a rotatable output shaft rotatingly driven by said engine and projecting forward therefrom;

a propeller disposed proximate a forward end of said rotatable output shaft;

a single duct disposed to house an axial flow air pressurization device mounted on said output shaft therein, said single duct having an intake end disposed proximate said propeller, and a discharge end operatively connected to said single air intake passage, said single duct configured to route air pressurized by said axial flow air pressurization device within said single duct to said single air intake passage of said engine; and a diverter disposed in said single duct to selectively route pressurized air into said single air intake passage of said engine and to discharge pressurized air away from said single air intake passage of said engine;

both said single duct and said single air intake passage being disposed between said propeller and a forward side of said engine.

2. The supercharged reciprocating piston engine according to claim 1, wherein said air pressurization device is an axial flow fan.

3. The supercharged reciprocating piston engine according to claim 2, wherein said air pressurization device is an axial flow fan having blade of pitch characteristics different from those of said propeller.

4. The supercharged reciprocating piston engine according to claim 2, wherein said propeller has propeller blades, and said axial flow fan has air pressurization blades arranged in staggered relationship to said propeller blades such that said air pressurization blades are directly exposed to incoming air passing between said propeller blades.

5. The supercharged reciprocating piston engine according to claim 1, wherein said air pressurization device is located in said single duct and on said output shaft between said propeller and said engine block.

6. The supercharged reciprocating piston engine according to claim 1, wherein said diverter is infinitely movable between a first position wherein at least most of the pressurized air is constrained to flow away from said single air intake passage and a second position wherein at least most of the pressurized air is constrained to flow into said single air intake passage.

7. The supercharged reciprocating piston engine according to claim 1, wherein said diverter is moved between said first and said second positions by a servomechanism.

8. The supercharged reciprocating piston engine according to claim 7, wherein said servomechanism is controlled by at least one of the control sources: a microprocessor, a control signal originating remotely from an aircraft carrying and powered by said supercharged reciprocating piston engine.

9. A supercharged reciprocating engine assembly for a miniature, unmanned aircraft, comprising:

a) an engine comprising an engine block defining at least one cylinder, a piston reciprocatingly and slidably disposed within said at least one cylinder, a single air intake passage for receiving combustion air and conducting said combustion air to said at least one cylinder; and a rotatable output shaft projecting forward from a front surface of said engine block;

b) a propeller having blades arranged in a first, predetermined radial arrangement and affixed to said rotatable output shaft proximate a distal end thereof;

c) a single duct having an intake end disposed adjacent to and rearward of said propeller, and a discharge end operably connected to said single air intake passage of said engine to route air from said intake end to said single air intake passage;

d) an axial flow air pressurization device disposed on said output shaft rearward of said propeller and within said single duct, for pressurizing air therein;

e) a diverter disposed within said single duct between said air pressurization device and said single air intake passage to selectively route pressurized air into said single intake passage of said engine and to discharge pressurized air away from said single air intake passage of said engine.

10. A supercharged reciprocating engine assembly for a miniature, unmanned aircraft as recited in claim 9, further comprising:

f) means for producing laminar air flow disposed within said single duct between said axial flow air pressurization device and said diverter.

11. A supercharged reciprocating engine assembly for a miniature, unmanned aircraft as recited in claim 7, wherein said axial flow air pressurization device comprises blades arranged in a second, predetermined arrangement, said second, predetermined arrangement being such that said blades of said axial flow air pressurization device are disposed in staggered relationship to said propeller blades such that said air pressurization blades are directly exposed to incoming air passing between said propeller blades arranged in said first, predetermined arrangement.

12. A supercharged reciprocating engine assembly for a miniature, unmanned aircraft as recited in claim 9, wherein said diverter is infinitely movable between a first position wherein at least most of the pressurized air is constrained to flow away from said single air intake passage and a second position wherein at least most of the pressurized air is constrained to flow into said single air intake passage.

13. The supercharged reciprocating piston engine according to claim 12, wherein said diverter is moved between said first and said second positions by a servomechanism.

* * * * *